United States Patent [19]

Saeedy

[11] 4,124,909

[45] Nov. 14, 1978

[54] BABIES BED

[76] Inventor: Mohammad R. M. Saeedy, End of "Rastakhiz" St., Lane No. 20, 5th Door on the left, Shiraz, Iran

[21] Appl. No.: 839,835

[22] Filed: Oct. 6, 1977

[30] Foreign Application Priority Data

Oct. 16, 1976 [IR] Iran ..... 19116

[51] Int. Cl.[2] ..... A47D 9/00; A47C 27/08

[52] U.S. Cl. ..... 5/99 B; 5/93 R; 5/114

[58] Field of Search ..... 5/93 R, 93 B, 99 R–99 C, 5/110, 114

[56] References Cited

U.S. PATENT DOCUMENTS 3,699,594 10/1972 Matthey Doret ..... 5/93 R 3,837,019 9/1974 Hoff ..... 5/93 R 4,015,297 4/1977 Christian ..... 5/93 R

FOREIGN PATENT DOCUMENTS 43,051 3/1910 Austria ..... 5/99 R

*Primary Examiner*—Casmir A. Nunberg

*Attorney, Agent, or Firm*—McCormick, Paulding & Huber

[57] ABSTRACT

A collapsible stand supports a collapsible bed by coupling mechanisms which permit the bed to be quickly erected and stowed for ease in movement from place to place. Each coupling mechanism includes a hub and radially extending members which are easily assembled to, the hub and foldable to positions aligned with the axis of the hub.

14 Claims, 46 Drawing Figures

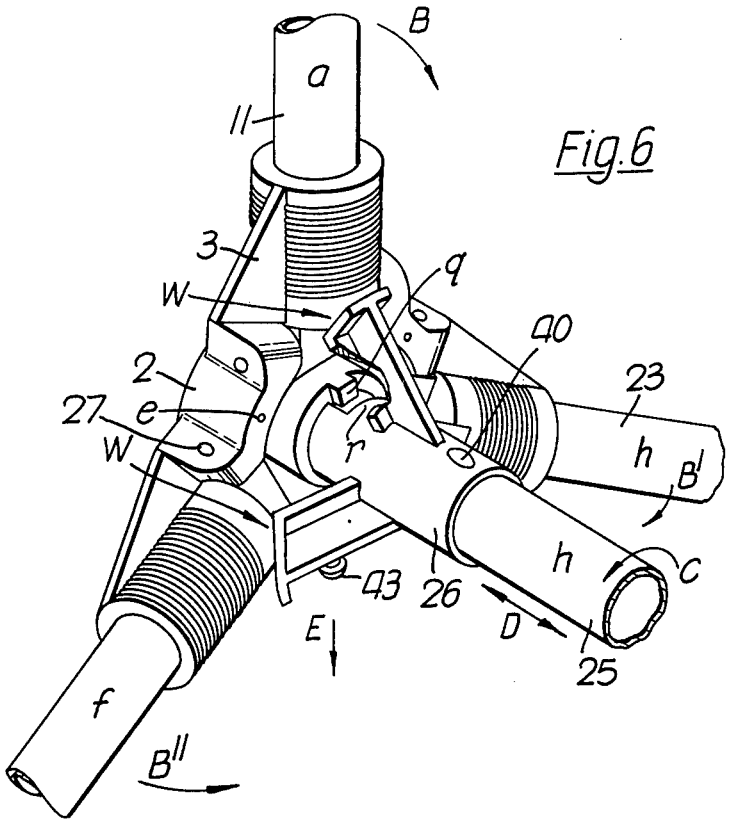
Fig.6
Fig.7
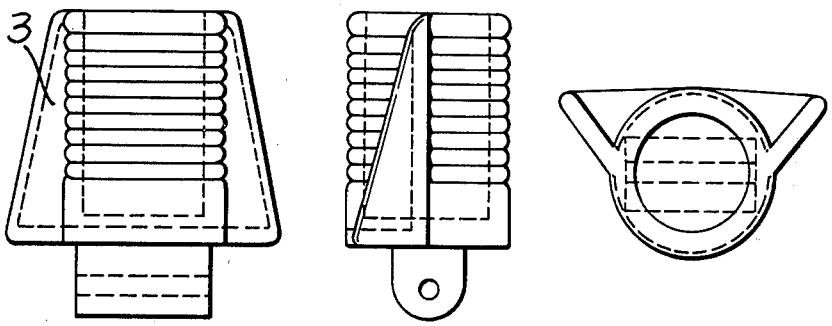

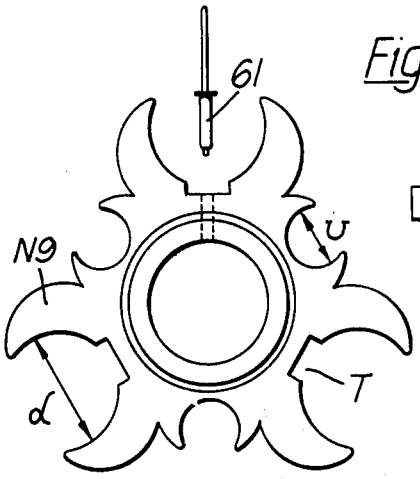
Fig. 21.
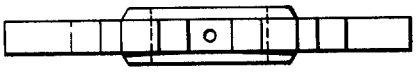
Fig. 22.
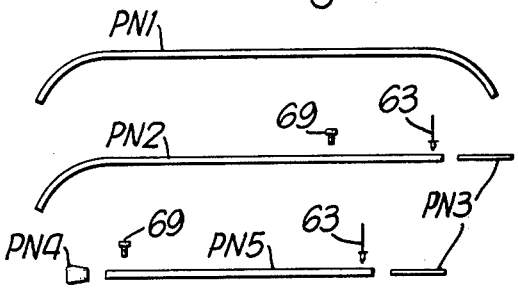
Fig. 24.
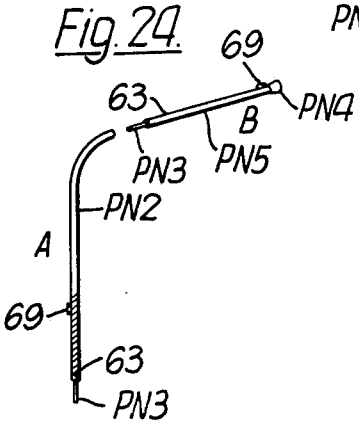
Fig. 23.
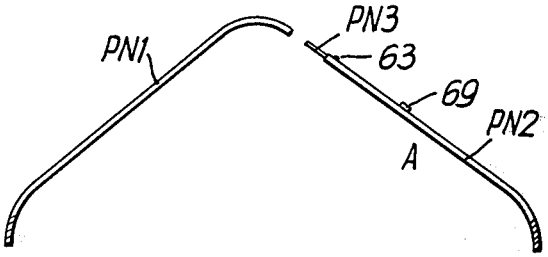

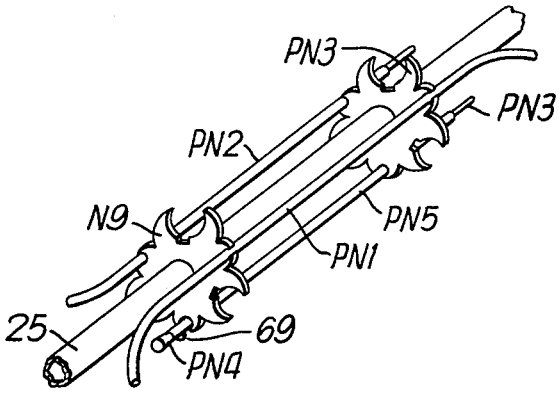
Fig. 25.
Fig. 26
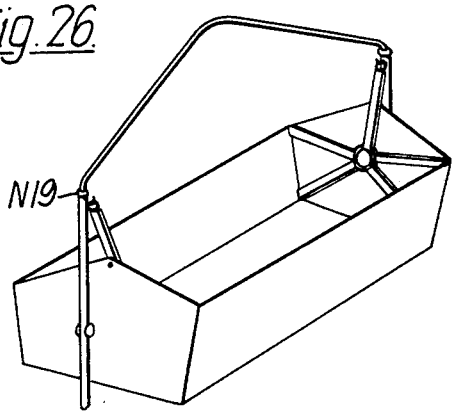
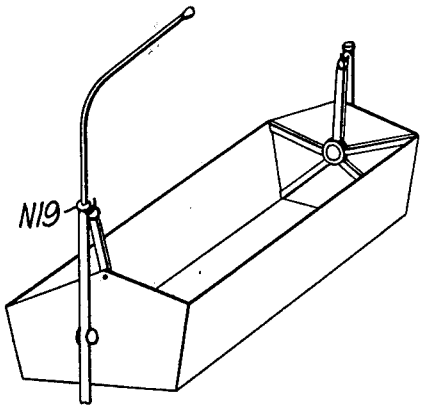
Fig. 27 z
N2
z

λ
36
G
m
N48
56
f
G
γ
a
a9
h
G
G
29
h
54
37
K
G

PN5
PN2
N50d
Ω
N19
N62
70
18
N11
63
PN3
PN6
PN7
Λ
N24
O
H
69
M

BABIES BED

The present invention relates to a cot assembly in which a cot is supported on a stand.

In this Specification the term "cot" is intended to include any structure suitable for supporting a reclining or sleeping person. Examples of such a structure are a bed or a hammock.

With conventional cots difficulties can arise when it is necessary to transport the cot from one location to another, particularly if it is necessary to carry the cot by hand or to store it in a confined space such as the boot of a car.

Cots are now used widely throughout the world, including those countries where it is possible and desirable to leave an occupied cot outside in a garden or an equivalent space during at least part of the year. If the cot is simply rested on the ground then in certain regions of the world the occupant may be at risk from attack by insects, reptiles or small animals.

It is an aim of the invention to provide an assembly in which the abovementioned difficulties are alleviated, and accordingly there is provided a cot assembly comprising a collapsible cot supported by a collapsible stand in which the stand comprises elongate frame members which are adjustable relative to coupling mechanisms to take up a first condition in which they retain the frame members in an operational support position, or a second condition in which they allow the frame members to be moved to a collapsed position.

In a preferred embodiment of the invention, the stand may comprise two upright support members, a longitudinal member, and two of said coupling mechanisms in which each coupling mechanism connects an associated support member with a respective end of the longitudinal member and with associated leg members. The support members and leg members may lie substantially parallel to the longitudinal member when they are in their collapsed position. Conveniently, the frame members and coupling mechanisms may be relatively rotatable between their said first and second conditions.

In one assembly of the invention, each coupling mechanism may comprise a housing member adjustably mounted on the longitudinal member, and projections fixedly mounted on the longitudinal member to abut the support member and leg members when in their operational position.

The cot may be formed by a cover mounted on a skeleton formed by elongate skeleton members.

Some of the skeleton members may be adjustably mounted on junction assemblies for movement between an assembled position and a collapsed position. Said some skeleton members may be rotatably mounted on the junction assemblies for movement between said assembled and collapsed positions. In order to retain the cot in its assembled position, said some skeleton members may be located in appropriate recesses in the junction assemblies when in their assembled position. Each junction assembly may include a central portion which is pressure responsive to initiate the movement of skeleton members from their assembled position to their collapsed position.

The assembly may include a net to protect the occupant of the cot from insects, and this net may be supported by a support structure mounted on the stand.

An embodiment of the invention will now be described by way of example with reference to the accompanying illustrative drawings in which.

Figure 3:
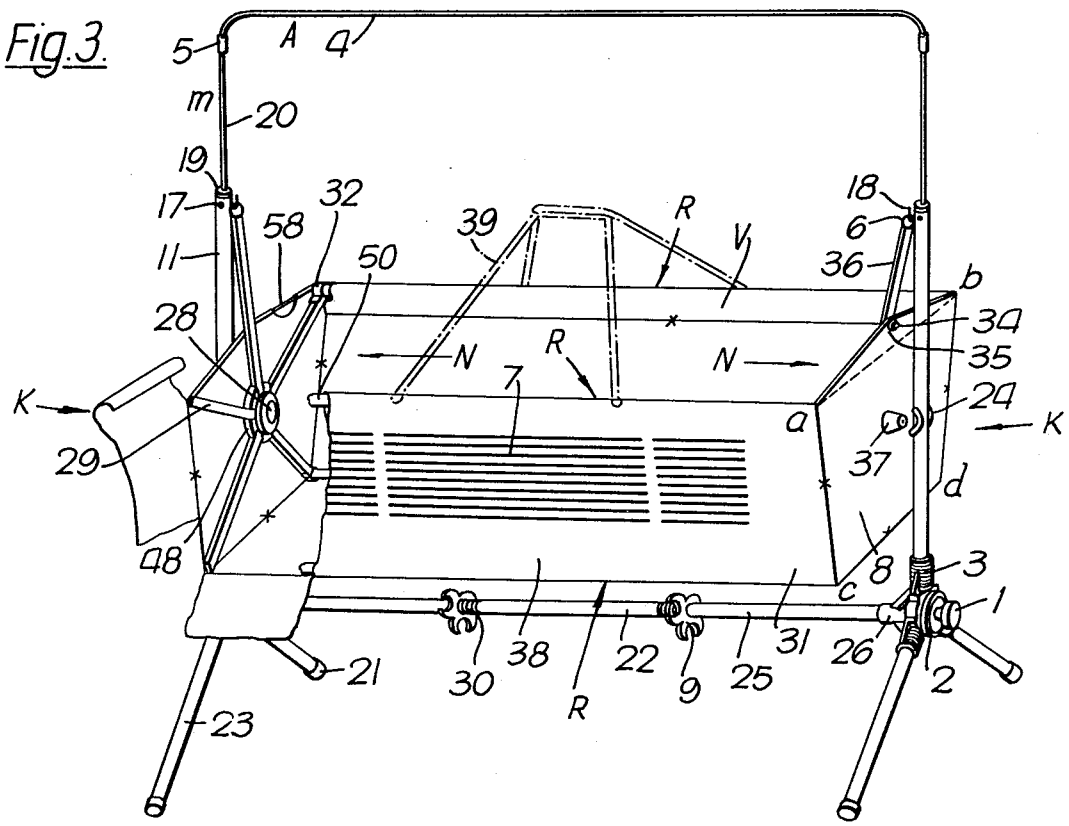
Figure 4:
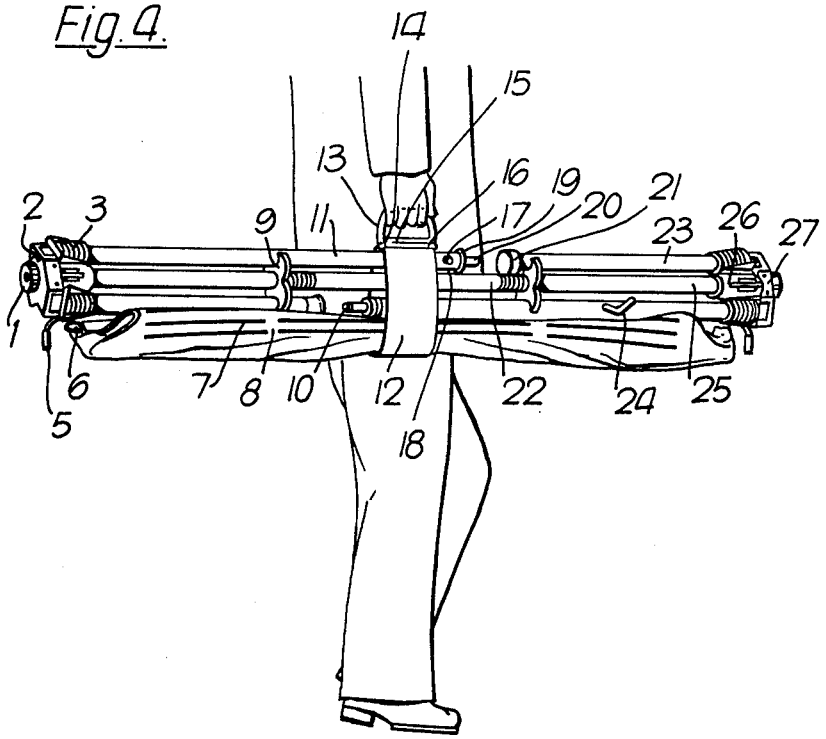
Figure 5:
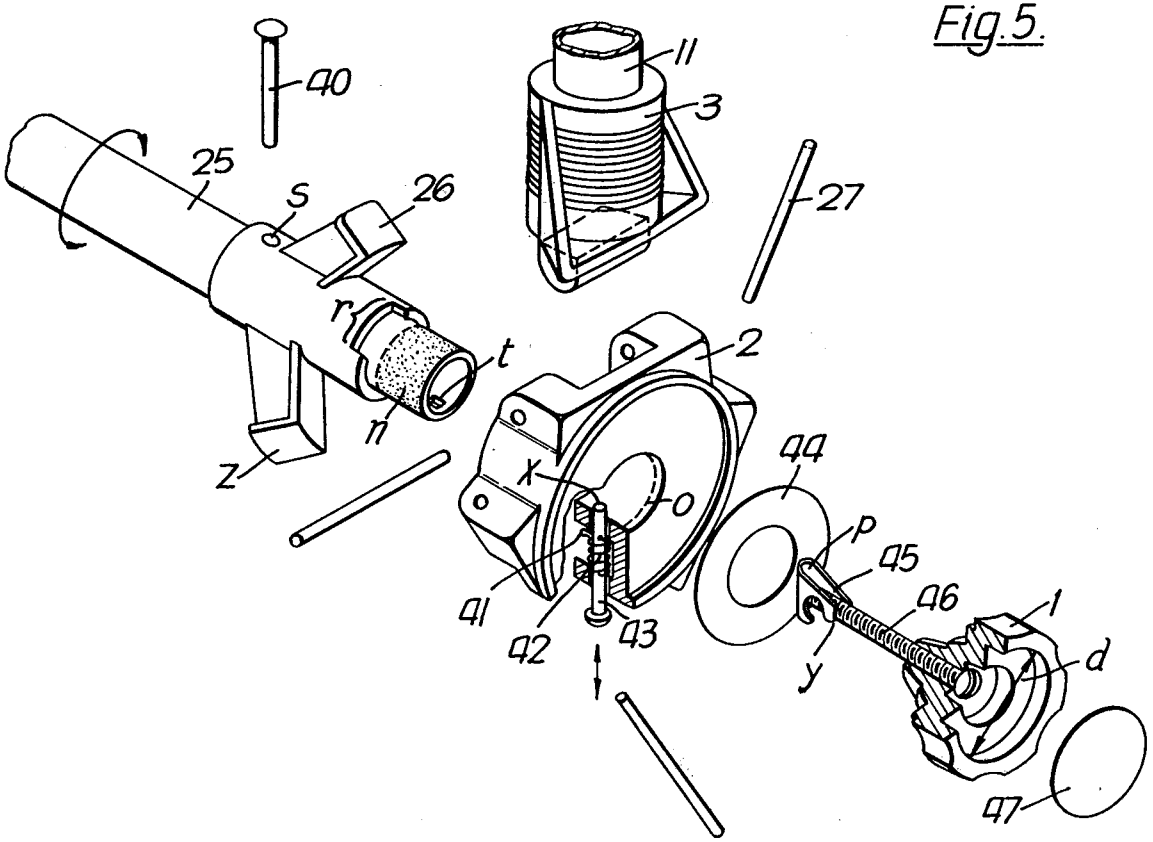
Figure 8:
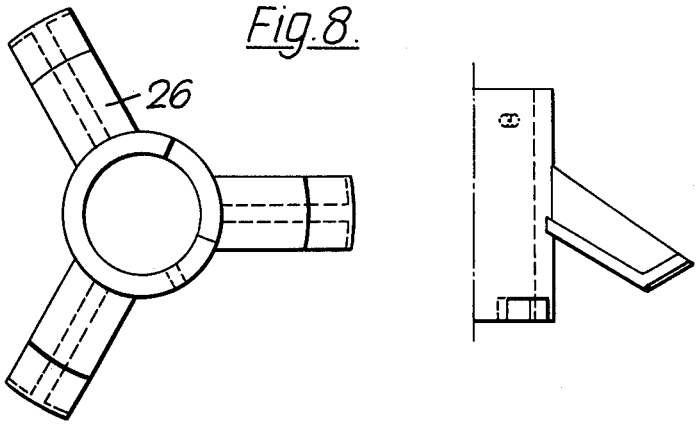
Figure 9:
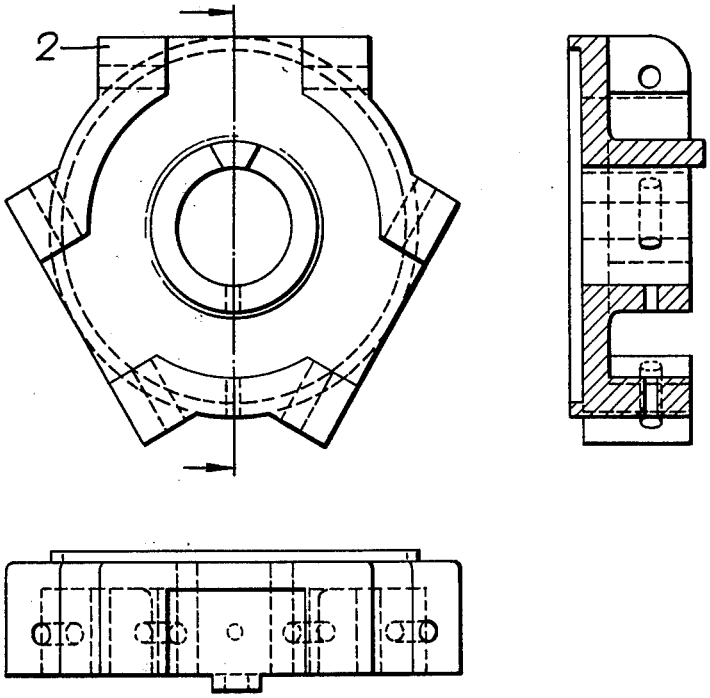
Figure 10:
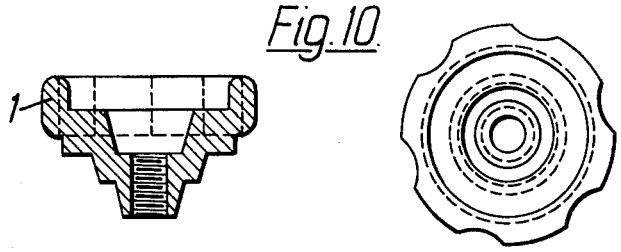
Figure 10A:
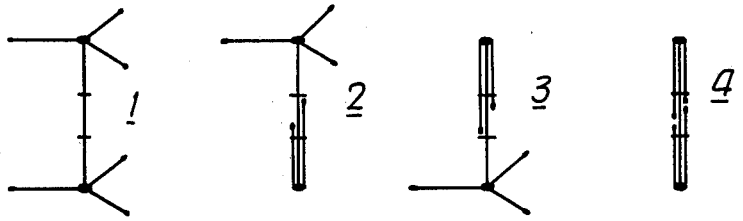
Figure 12:
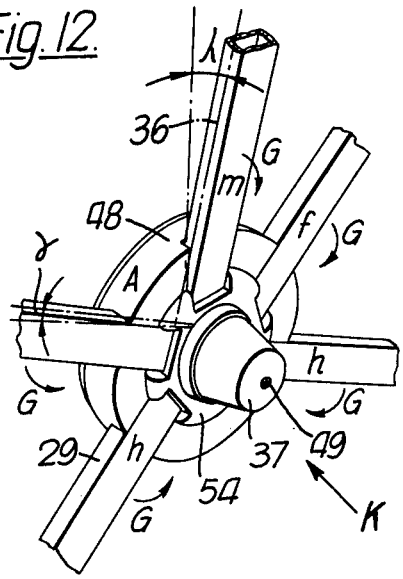
Figure 13:
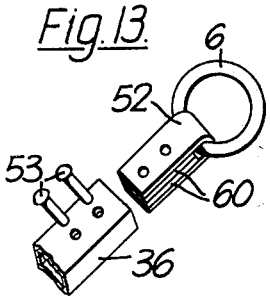
Figure 11:
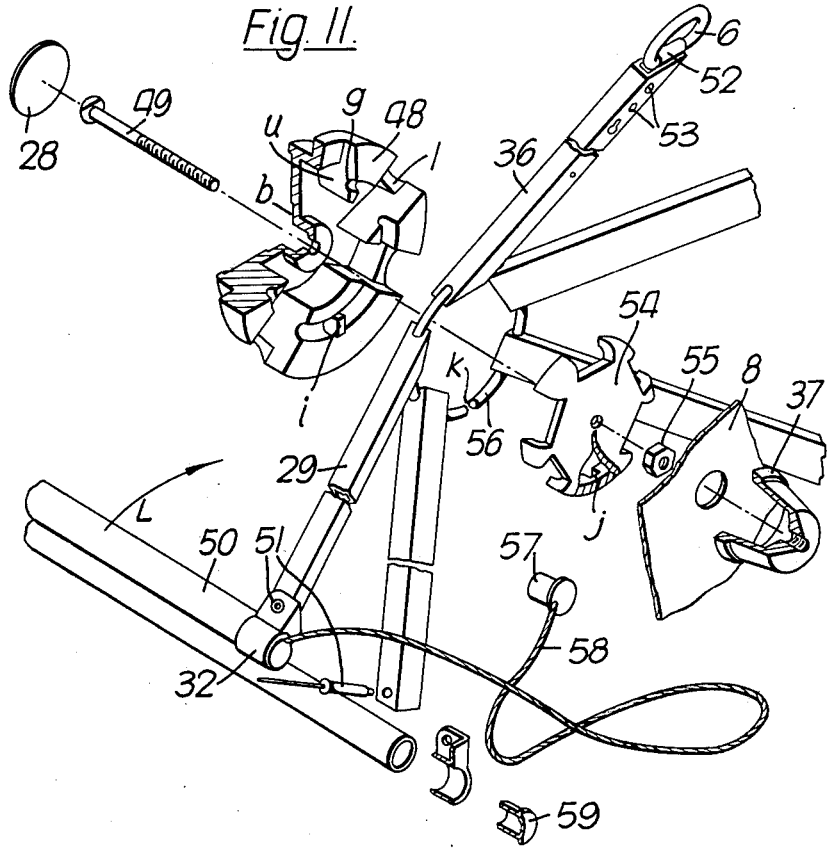
Figure 14:
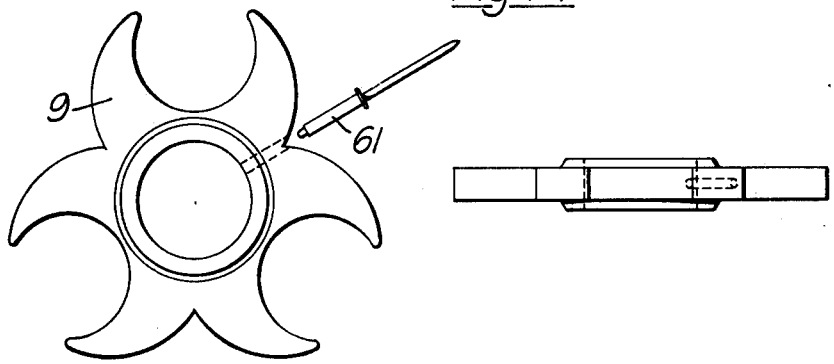
Figure 15:
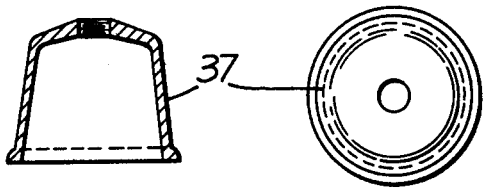
Figure 16:
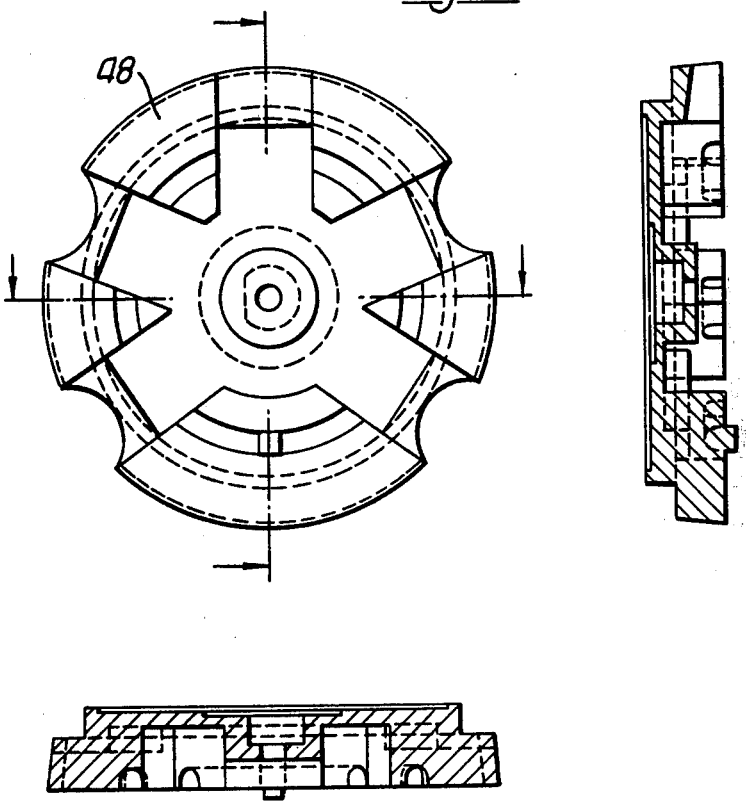
Figure 17:
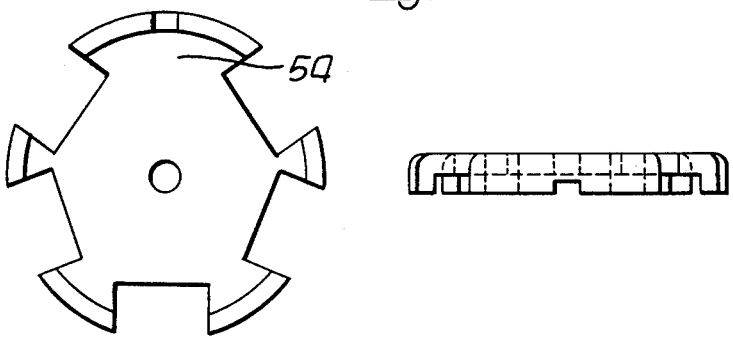
Figures 18, 18A:
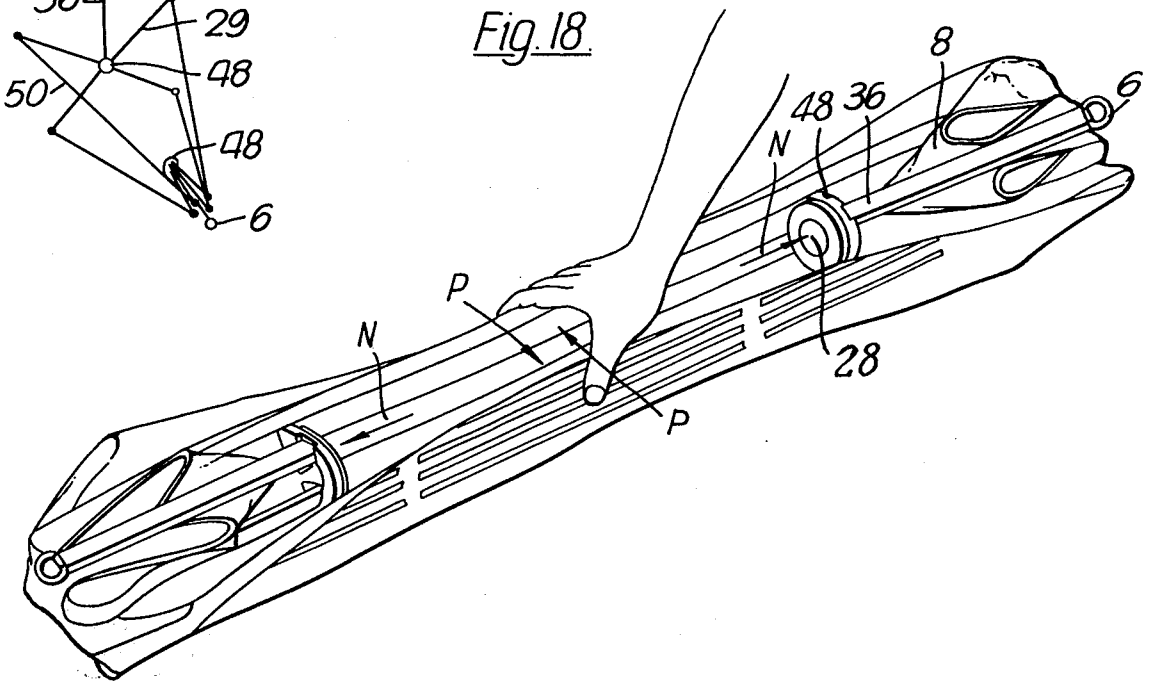
Figure 19:
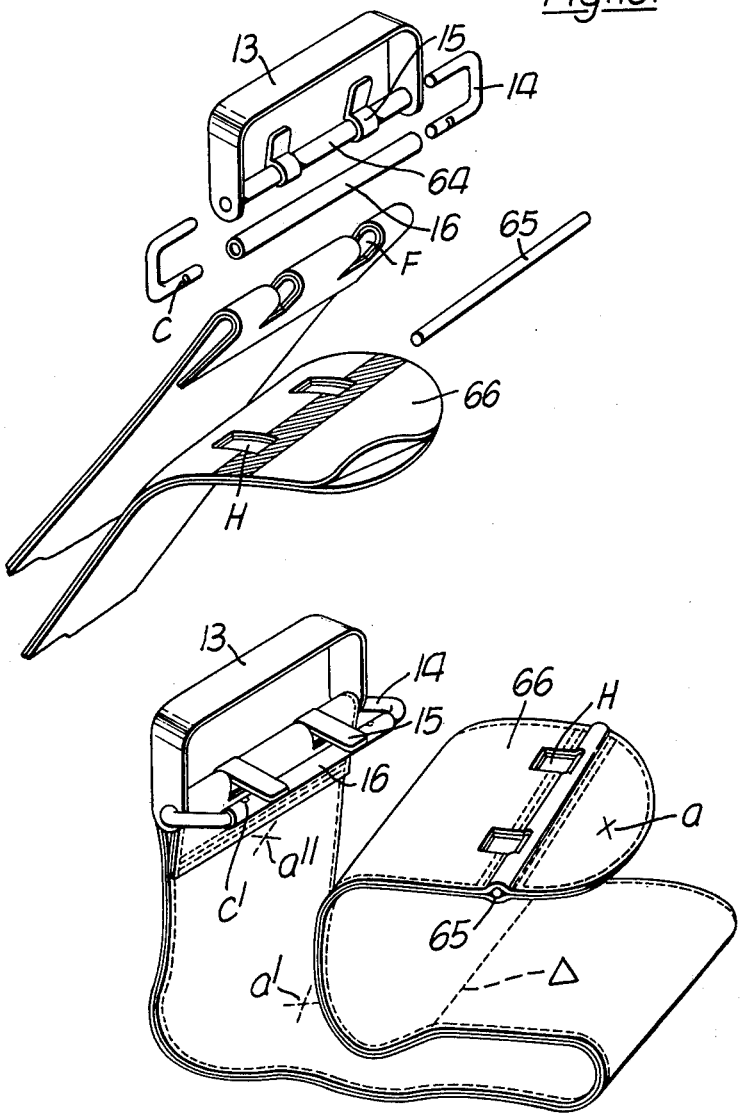
Figure 20:
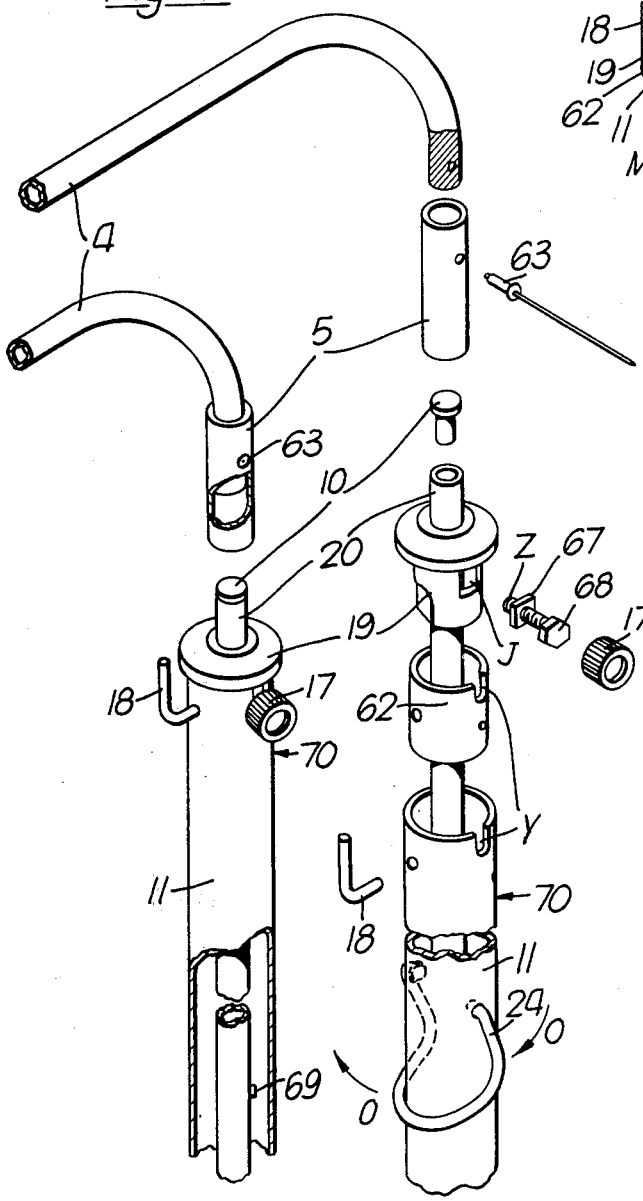
Figure 20A:
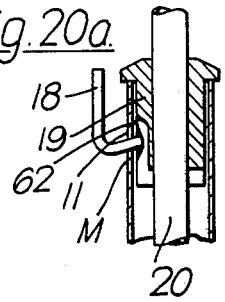
Figure 28:
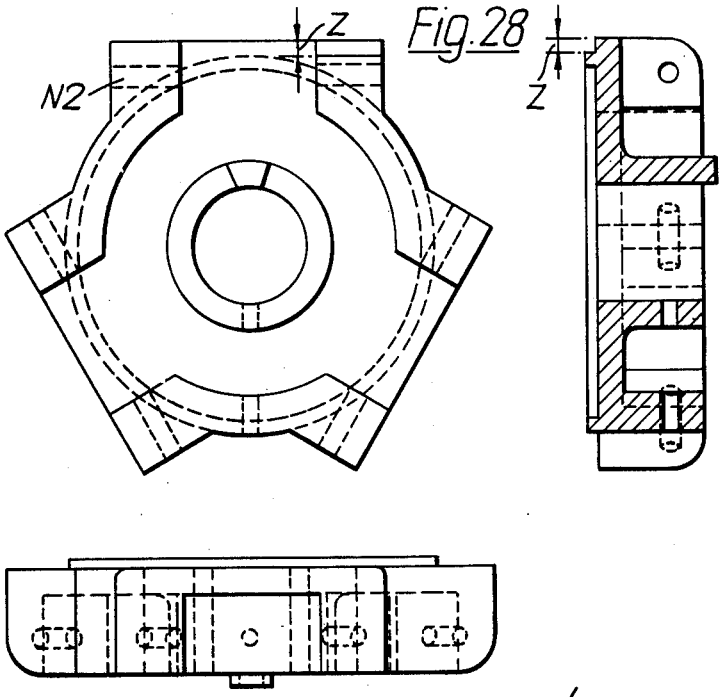
Figure 29:
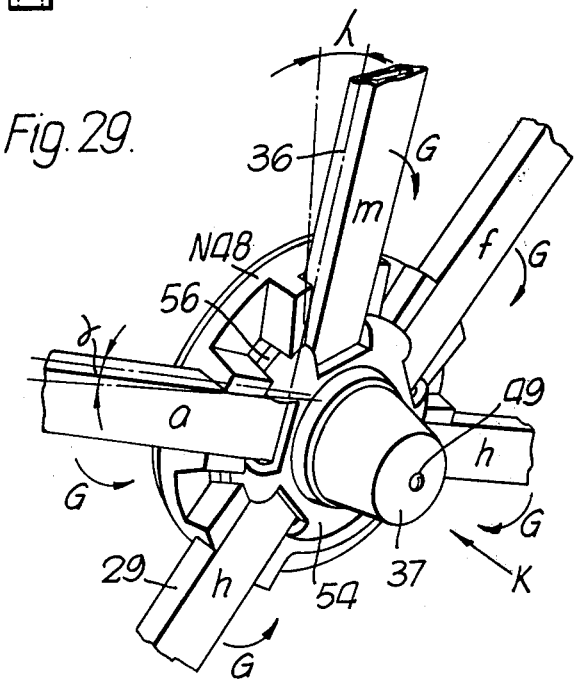
Figure 30:
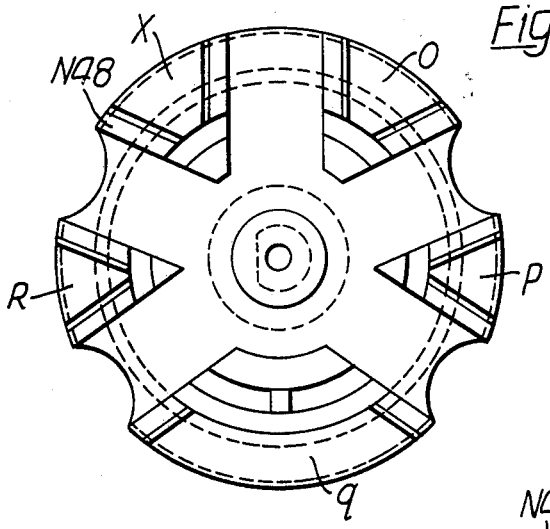
Figure 31:
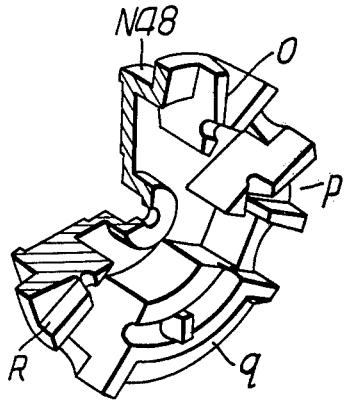
Figures 37, 38, 39, 40:
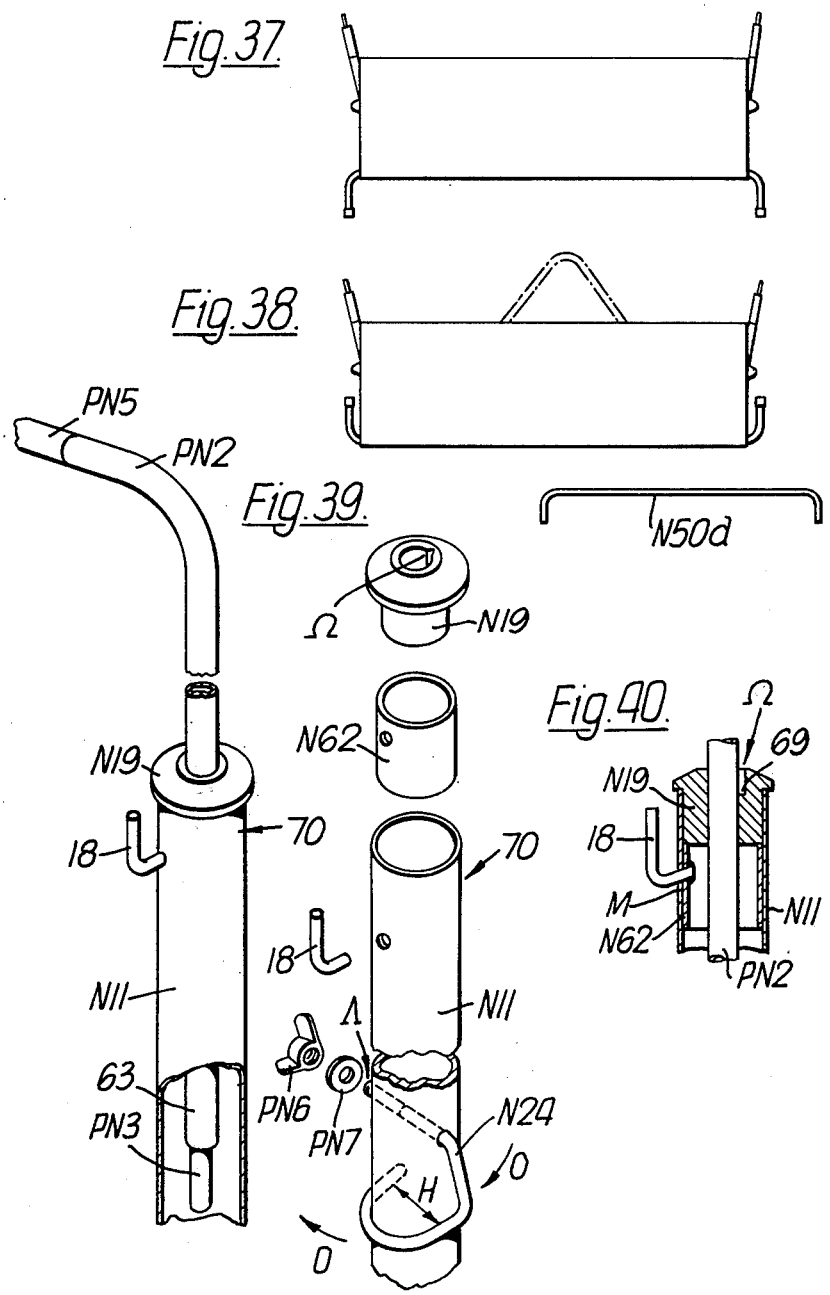

FIG. 3 is a perspective view, partly cut-away, of the assembly in its operational position, FIG. 4 is a perspective view of the assembly in its collapsed position, FIG. **4*a* is a diagrammatic detail view of part of the cot of the assembly, FIG. 5 is an exploded perspective view of part of a coupling mechanism of the assembly stand, FIG. 6 is a perspective view of an assembled coupling mechanism of the stand, FIGS. 7 to 10 illustrate views of component parts of the coupling mechanism, FIG. 10*a* illustrates four stages in the collapsing of the assembly stand, FIG. 11 is an exploded perspective view of a junction assembly of the cot, FIG. 12 is a perspective view of an assembled junction assembly of FIG. 11, FIG. 13 is a perspective view of part of a cot attachment member, FIGS. 14 to 17*b* illustrate component parts of the assembly, FIG. 18 is a perspective view of the cot when collapsed, FIG. 18A is a diagrammatic illustration of the cot skeleton when partly collapsed, FIGS. 19 and 20 are perspective views of component parts of the assembly, FIG. 20*a* is a side elevation in section of a component part of the assembly, FIG. 21 illustrates a modification of a component illustrated in FIG. 14, FIGS. 22 to 27 illustrate the insect net support of the assembly, FIG. 28 illustrates a modification of a component illustrated in FIG. 9, FIG. 29 illustrates a modification of the junction assembly illustrated in FIG. 12, FIG. 30 illustrates a modification of the component illustrated in FIG. 16, FIG. 31 is a perspective view of the component illustrated in FIG. 30, FIGS. 32 to 38 illustrate components of the invention, and FIGS. 39 and 40 illustrate modified versions of the components illustrated in FIGS. 20 and 20A**.

Figure 1:
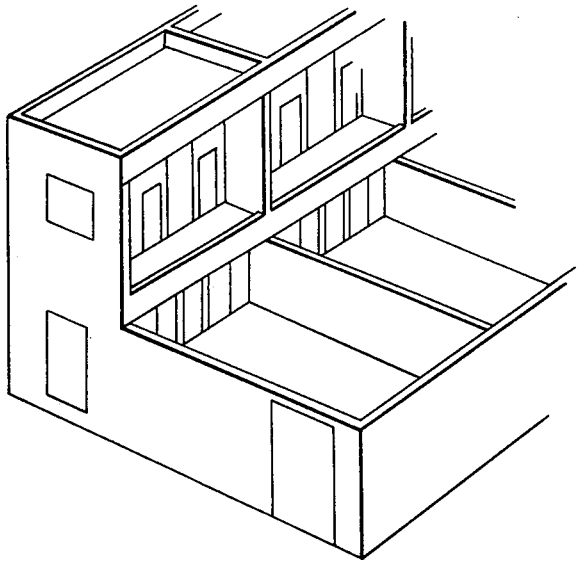
FIG. 1 illustrates a dwelling in which the cot may be used.
Figure 2:
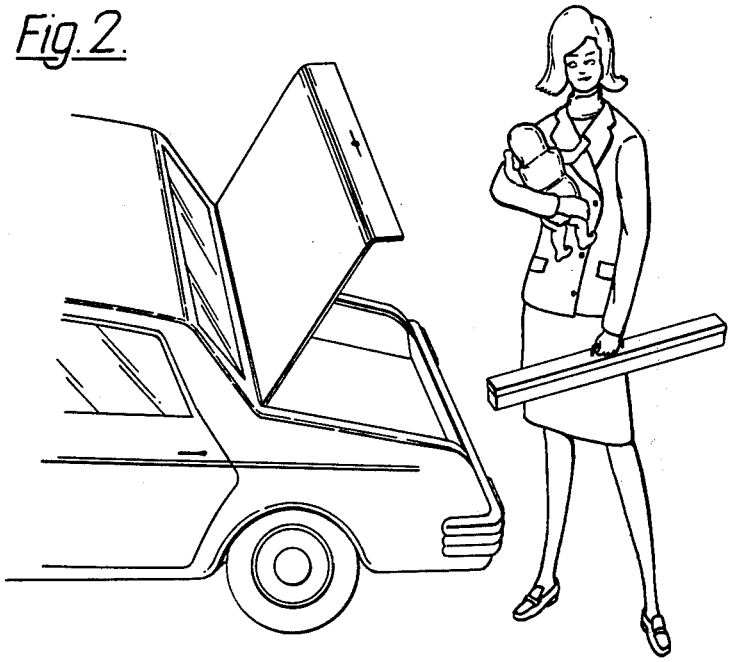
FIG. 2 illustrates how the collapsed assembly may be stored in a car boot.

Referring to the drawings FIGS. 1 and 2 show the symbolic application of the invention. FIG. 1 indicates that the invention is generally used in homes and indoors while FIG. 2 also shows the dimensions of the box containing the assembly placed in a folded or collapsed position inside. FIG. 2 shows the approximate size of the boxed collapsed assembly in relation to a human figure and a car illustrating at the same time that the boxed assembly will occupy a small space in the car.

FIG. 3 shows the assembly in its operational or set up position, and FIG. 4 illustrates the dismantled assembly ready to be packed into the box.

Looking at FIG. 3 it will be seen that the cradle body can be easily mounted on or detached from the stand. Starting with the cradle stand; it will be seen in FIGS.

3 and 4 that the stand includes two coupling mechanisms placed symmetrically on the two sides of the stand. A longitudinal frame member 25 connects the two coupling mechanisms in a special way. Two leg members 23 rest on the ground and a support member 11 stands vertical to the ground. The members 11, 23 and 25 are all made of the same material and selected from light aluminium, steel, hard polyethylene tubes PE-DIN 8075 JUL 160 or any other light weight tubes.

Star catches 9 are fixed in their specific places shown in FIG. 3 by long rivets 61 (shown in FIG. 14). The openings of these catches are precisely opposite each other. The catches are made of hard plastics, and the hardness will be to the extent that all three openings of the catch are opened and closed under pressure with appropriate elasticity to support and lock the stand members as shown in FIG. 4.

FIG. 5 shows the components of one of the coupling mechanisms of the stand, and FIG. 6 shows the assembled parts of the coupling mechanism in isometric perspective. FIG. 5 shows how the part 43, spring 42 and special pin 41 are assembled forming a catch. It is evident that pulling down and releasing part 43 it will jump up back to its place under the pressure of the spring 42.

As seen in FIG. 5, section *n* on member 25 is shown by a dotted area. This section will easily and freely insert into the central opening of the part 2 when pulling down and holding the catch 43 until reaching the imaginary line O. In this position, on releasing the catch 43, the tip *x* of part 43 will enter the oval slit *t* if the slit *t* is facing the tip *x*. It is obvious that in this position, the projection *q* of part 2 has entered the cut *r* of part 26. Now the parts 45 and 46 welded at point *y* are passed through a washer hole 44 entering in the central hole of the part 2. In other words, parts 45 and 46 enter the tubular member 25. Now the rivet 40 can be passed through the hole *s* and slit *p* if the slit *p* of part 45 is placed facing the hole *s* in parts 25 and 26, and the head of the rivet 40 can be riveted down when the rivet head 40 has appeared from the other side of part 26 out of the hole devised opposite hole *s* in part 26. The tri-prong 26 is already mounted on the tubular member 25. Also the part 1 has been mounted on the part 46 before the parts 45 and 46 were welded together.

The part 44 is made of a thin layer of plastics and is used to avoid friction between parts 1 and 2 caused when rotating part 1. Tubes 11 and 23 are already pressed into the segments 3. Alternatively the tubes are placed inside casting moulds of an injection system made to produce part 3 so that the tubes are surrounded by molten material, and the part 3 together with the tubes will come out of the cast in a solid and connected condition. Upon joining the tubes 11 and 23 to part 3, the parts 3 of these tubes are connected to the part 2 by pins 27. Finally the cover 47 is glued to the bottom of an opening *d* in part 1 by a special glue. Now all the components of the coupling mechanisms of the cradle stand are assembled as shown in FIG. 6. Looking at FIGS. 3 and 4, the assembled position of the coupling mechanisms is seen from a different angle.

Considering the assembling procedure of parts and their structure in the coupling mechanisms of the cradle stand already described, we will notice that all three members of the cradle mechanisms are inclined to pivot around the pins 27 and to rest and fold on the tube 25 as per the direction of arrows B B′ B″ shown in FIG. 6. However another tri-prong or the smaller tri-prong 26 will prevent the main larger tri-prongs of the coupling mechanism stand from pivoting. This means that a point in surface *z* of each of the three prongs of part 26 is in contact with a point *w* of every part 3.

Turning and tightening handle 1 presses surfaces *z* against the points *w* causing members 23 and 11 not to fold and to rest on member 25 whereupon it will be fixed in place without loosening. Looking at FIG. 6, we can also discover that the said tri-prongs (i.e., prong members 23 and 11) can under no conditions be folded against the direction of B B′ B″ arrows.

There is exactly the same mechanism at the other end of the tube 25 shown in FIG. 6, and it is evident that FIG. 6 shows the cradle stand at the extended and set up position. To collapse the cradle stand each of the coupling mechanisms on both sides of the stand is folded separately. To do this, the special screws 1 on both sides of the stand are turned left to loosen. We shall then lift the whole cradle stand and place it on the ground so that the member 25 stands vertical to the ground (position 1) in FIG. 10A. The cradle stand is shown in four positions in FIG. 10A. In this position 1, we shall pull the catch 43 in the direction of arrow E, hold it and then turn the tubular member 25 in the direction of arrow C till three *z* surfaces of tri-prong 26 is placed approximately opposite the *e* regions. Then each of the larger three prongs of the coupling mechanism or the two prongs 23 and prong 11 are lifted up one by one in the direction of B B′ B″ arrows until placed opposite the opening of star catch 9 (the place and opening of star catch 9 is already so adjusted and fixed on the tube 25 that the coupling mechanism prongs of the cradle stand are placed precisely opposite). Now pressing the prongs into the openings of the star catch, the coupling mechanism prongs of one side of the cradle stand is locked, (position 2 in FIG. 10A). The cradle stand is then placed on the ground upside down as per position 3 of FIG. 10A and the same locking process is repeated to fold the coupling mechanism of this end of the cradle so that the cradle stand is fully collapsed to position 4. The stand fully folded on the body is shown in FIG. 4. The mosquito net and cradle body are indeed folded individually before the cradle stand is folded.

The part 24, the body tightener, hook 18, parts 17, 19 and other parts hidden inside the prong 11 will be described separately.

The projection *q* limits the pivoting of tube 25 around it. The tube 25 can move and be slightly loose in both directions of arrow D when part 1 is not tightened.

As appears in FIG. 3, the space on the tube 25 between the two star catches 9 are covered by a cover 22 on both sides of which lines 30 are drawn. The cover is made of soft polyvinyl chloride "DIN 8062 JUL160" or generally of the same material used to cover the cradle body.

There are also caps 21 in FIG. 4 which are mounted on the end of part 23. The caps are made of plastics or rubber. Parts 3, 2, 26 and 1 can be made of aluminium, hard but not fragile plastics, hard polyethylene or other suitable materials so as to be both light, strong and capable of producing these parts by casting in fixed moulds.

FIGS. 3 and 4 shows the cradle body in operational (set up) and (folded) dismantled positions. The folded position of the cradle body is also shown in FIG. 18. Viewing these Figures, we will find out that the cradle body includes two junction assemblies placed symmetrically on both sides of the body. These assemblies each consist of five prongs.

The components of the cradle body's junction assemblies are shown in detail in FIGS. 11, 12 and 13 in isometric perspective. Also FIGS. 15, 16 and 17 show parts 37, 48 and 54 of the body's junction assemblies.

Referring to FIG. 11, the parts are assembled as follows:

Initially the ring 56 is mounted in its place in the groove *g* while the four parts 29 and part 36 are assembled on it in a way that projection *i* of part 48 enters the slit *k* in part 56 and further each of the four prongs 29 and prong 36 will be settled in their places in channels 1 and *u* respectively. In this position, part 54 is mounted on part 48 in a way that the projection *i* enters the slit *j*. The bolt 49 is passed through the central hole of parts 48 and 54 and the nut 55 is screwed on the bolt 49 and tightened to support the ring 56 in place by the part 54. Part 8 is a section of the cradle body cover. The full cover of the cradle body consisting of parts 8 and 31 can be seen in FIG. 3. Returning to FIG. 11, after tightening the nut 55 over the bolt 49, the end of bolt 49 which is rather long is passed through part 8 of cradle body cover in a way that nut 55 will also enter the hole and the cover would correspond to part 54 surface. The cap 37 is then screwed and tightened to the end of bolt 49 to press and support the cover 8 to the surface of the part 54.

Four light tubes 50, already pressed and tightened by both ends inside parts 32 are passed through the sheaths *v* and *v'* (FIGS. 3 and 4A), and joined to parts 29 by long rivets 51. Parts 57 and 59 are made of plastics of identical and suitable softness, different only in that part 57 has a hole to receive the plastics rope 58 of low thickness with the end to be tied inside the part 57. Parts 59 are placed at the four ends of the tubes 50 which are located at the lower part of the cradle body, and the part 57 will be placed at the four ends of tubes 50 located at the upper part of the cradle body while the end of the rope 58 is tied inside them. The narrow rope 58 will pass through the upper edge of part 8 of the cradle body's cover which is in the form of a sheath as well as from above the bolt 35 and from under the washer 34.

The passage of the rope 58 from the upper edge of part 8 is shown in FIG. 3.

The disc 28 is glued by special adhesive on top of the bolt 49 at point "*b*" spaced on part 48 upon assembling all parts of the cradle body junction assemblies. The connection of the ring 6 to the part 36 is given in FIG. 13 and FIG. 12 shows the central part of the body's junction assembly in the assembled position. The five prongs of each junction assembly cannot move against the direction of G arrows, and the Figure shows each junction assembly in the assembled position it adopts when the cradle is extended and set up.

Under such conditions, none of the five junction assembly prongs may be set on an imaginary plane surface, but prong 36 will stand slightly over the surface towards us forming an angle with the imaginary surface like λ and the other four prongs 29 will stand slightly behind the surface forming a α angle with the said surface.

Considering the points just described, FIG. 12 shows each junction assembly of the body in the following position:

1. The cradle body is extended and set up.
2. The five prongs may under no circumstances be moved against the direction of G arrows.
3. The five prongs are not standing on a surface and are forming λ and α angles as stated above.

The above three characteristics are due to the structure of part 48 and the recessions developed in the said part. Now taking off the cradle body from the stand, setting it on the ground, and pressing the central part of each junction assembly in the direction of *k*, the five prongs of each junction assembly the four prongs 29 of which are joined to light tubes 50, and the other prong 36 connected with ring 6, shall start to move in the direction of G arrows and the cradle body actually starts collapsing. It is evident that as the prongs are moving in the direction of G arrows, the four tubes 50 will also start moving in the direction of L arrows (FIG. 11) to reach prongs 29 and set upon them.

The following are the actions required to collapse the cradle body in full:

1. The rings 6 are taken off the hooks 18, to separate the body which is placed on the ground.
2. The central part of each junction assembly on both sides of the cradle are pressed in simultaneously in the direction of *k* arrows, and the cradle starts collapsing.
3. The four tubes 50 are pressed inside the cradle body in the direction of R arrows and the cradle body will be fully collapsed and folded.

FIG. 18 shows the cradle body in the fully collapsed position. In FIG. 18A, the cradle body structure is shown in a position where one side is collapsed and the other side is extended. FIG. 4 shows the cradle body and the stand in a fully collapsed condition.

The angle λ is characteristic in that the part 36 (FIG. 3) is placed in such convenient angle that the ring 6 can be easily joined to the hook 18. However the characteristic of α angle is of high and basic importance. In other words each junction assembly will never collapse by itself when it is extended or the cradle is set up, whether a baby is in it or not, and this is due to the α angle.

Figure 4A:
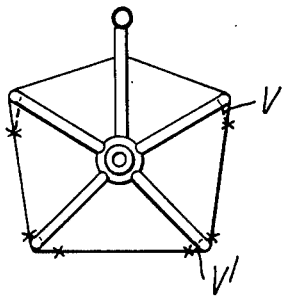

The cradle body's cover consists of parts 8 and 31, and each one of these parts may be made of a single or double ply material. Part 31 which is of a rectangular shape is covering the cradle's two sides and the bottom. The sewing lines or the connection points of trapezium shape parts of 8 to part 31 marked on those lines by (*x*) are shown in FIG. 3. The cross section of the cradle's body is shown in FIG. 4A. The passage of tubes 50 through the sheaths *v* and *v'* is shown in the said cross section.

The sewing points of the sheaths are also marked by (*x*) in the said cross section. No *v'* sheaths will be formed if part 31 of the body cover is made of a single ply material, as there is no second ply for the part 31 to pass through the dotted line of sheaths *v'*. In this case only one ply will pass from under the two tubes 50 provided on the lower part. The cradle body's cover can be made of soft plastics, tarpaulin canvas, soft polyvinyl chloride DIN 8062 Jul160, cloth, or other suitable materials. Handles 39 are mounted on the body in a dotted line in FIG. 3. The handles show that the cradle body can be individually used to carry the baby outdoors.

The invention also covers a new portable and collapsible bed to carry the baby. The bed is created by adding the handles 39 and taking off the prongs 36 with two four pronged mechanisms and joints 50. In this case, the upper edges of part 8 is shown in dotted line in FIG. 3, through which the edge of the narrow rope 58 is passed joining the two ends of tubes 50 together as already described. Other particulars of this bed is exactly like the cradle body shown in FIGS. 11 to 17B. Therefore we can actually say that the bed is the same cradle body with the junction assemblies and very slight changes such as adding handles 39, taking off prongs 36 and straightening the upper edge of part 8 of the body cover. Also the cradle body can be changed to the said bed just by taking off part of the prongs 36.

The outer cover of the cradle body or the above portable and collapsible bed can be printed with a striped design as shown in FIG. 3, or any other design by the Silk Screen method.

The material used for printing can be of Matvinyl, Glassvinyl, Plastiglas or other formulas which are resistant to light, heat and washing. Any brand name or mark 38 can also be printed by the same silk screen system. The design 7 or any other design can be created on part 31 or attached by flexible plastics or sewn to the part 31. The design 7 and mark 38 may be printed on other suitable materials and attached to the cradle body or the portable bed. Design 7 or any other design may be made of knitting because the entire body cover may be of knit material. Parts 48, 54, 37 and 32 may be made of aluminium, unbreakable hard plastics, hard polyethylene PE-DIN 8075 JULI 60 or other suitable materials by injection moulding.

FIGS. 20 and 20A illustrates the mechanical parts of a mosquito net, hook 18 welded into part 11 and the special part 24. As the hook 18 should be made of steel to be sufficiently strong, it can not be directly welded to the tube 11 which is not made of steel. Therefore, a part 62 made of steel is pressed in tube 11, and then the hook is welded to part 62 at its point M as it is shown in FIG. 20A.

A nut 67 is entered into the square hole J of part 19 while mounted on bolt 68. Holding the nut 67 in the said hole J the part 19 is pressed into the part 62 which is already placed in the tube 11. As a result, the screw 68 is placed inside the oval slit of *y* shape. It should be pointed out that the bolt head 68 is hammered at the point *z* after mounting the nut 67 on the bolt 68 so that the bolt 68 can never move out of the nut 67. Upon assembling the above parts on each other, the screw 70 is turned and placed, and a cap 10 is placed in a part 20 at the point shown. A plastics cap 17 is pressed on top of the bolt 68. The tube 20 can easily move inside the part 19. Therefore on loosening the bolt 68 by turning to the left the cap 17 we may take out the tube 20 from the part 19 and holding it at any desired height fix and tighten it in place by turning cap 17 to the right which will tighten the bolt 68 and contact its tip *z* with the tube 20.

A screw 69 will stop the tube 20 from moving out of the part 19 too much or getting totally removed. Paying attention to marks made on the tube 20, these tubes can be lifted on both sides of the cradle through parts 19 to equal heights and fixed at those heights.

Tubes 5 are connected with the two ends of a joint tube 4 by long rivets 63. The ends of the tubes 20 on the two sides of the cradle stand are inserted into tubes 5 which can be readily handled, and the two tubes 20 are connected to the tube 4 as shown in FIG. 3. The combination of the tubes 20 and 4 form a mosquito net structure which when covered by a net can bar the entrance of mosquitoes or sunlight. A part 24 (FIG. 20) can be moved up in the direction of O arrows, placed on a part 37 of the cradle body (FIG. 3) and pressed down a little until the part 37 is placed inside the opening of the part 24. Now the cradle body is fixed and can no longer move. The fixer 24 is used when desiring to use the cradle as a fixed bed. Parts 10 and 19 are made of plastics and parts 20, 4, and 5 are of light steel, aluminium or other materials including hard plastics. Parts 18 and 24 are made of steel.

FIG. 19 illustrates the complex mechanism of the cradle's handle and special belt. The parts of this mechanism are shown in detail in the upper part of this Figure, and the lower part shows the mechanism in its assembled position. Upon passing a tube 64 through the hooks 15 the tube will be held in the point shown between the opening of handle 13. Then a tube 16 will be held in place shown parallel to the tube 64. In this position, the U shaped prongs 14, in which a number of recessions *c* are devised, will enter the tubes 64 and 16 from both sides, and the handle 13 and tubes 64 and 16 are joined together. We shall now press the recession points *c'* on tube 16 right in front of the recessions *c* so that small projections of tube 16 will enter the recessions *c* in point *c'* preventing the U shaped parts 14 from moving out of the tubes 16 and 64. We shall then pass the tips of the hooks 15 through the holes F devised on a band 66 (ribbon), and then fold the ribbon edge and sew it to the ribbon itself as per the dotted line shown in the lower part of FIG. 19. The ribbon 66 is of the same material as the cradle body which is of double ply. The wire 65 has entered between the two plys of the ribbon 66 in the shaded point shown to prevent the tearing of holes H and to provide greater strength for the holes against pressure; and it will be sewn on both sides as shown by dotted lines in the lower part of FIG. 19. As shown in dotted lines, the two layers of ribbon 66 are all sewn together at the edge.

Similar wires can be passed through the two layers of the ribbon in other points which for example has been shown on the ribbon 66 by dotted Δ lines, and create the holes H so that cradle body can be carried outdoors without the stand and be strengthened by the ribbon. A button can be attached to the end of the ribbon at a point marked by *x*. Upon passing the hooks 15 through the holes H, the ribbon end can be fastened by the button (*a*) to its pair marked at points *a'* and *a''* by (*x*) and not visible in the figure when folding and securing the cradle stand and body on each other or when folding the cradle body individually to carry outdoors.

It should be further explained that (*a*) is fastened to (*a''*) only when it is desired to tighten the collapsed cradle body and stand together for carrying, and when it is desired to fasten and carry the cradle body individually; in this case the button (*a*) is fastened to its pair of (*a'*).

As already mentioned, it takes about 1 to 1.5 minutes to extend and set up the cradle as follows: Upon removing the cradle from its carton box, the previously mentioned handled band (FIG. 19) is removed from around the cradle. Initially the cradle stand (FIGS. 4 and 6) is set almost vertically on the ground (FIG. 10A position 4), while one hand is supporting it, we remove each of the three prongs individually of the side set on the ground from the star catch 9 and extend it on the ground by the stand and just strengthened by the ribbon. A button can be attached to the end of the ribbon at a point marked by *x*.

Upon passing the hooks 15 through the holes H, the ribbon end can be fastened by the button (*a*) to its pair marked at points *a'* and *a''* by (*x*) and not visible in the figure when folding and tightening the cradle stand and body on each other or when folding the cradle body individually to carry outdoors. It should be further explained that (*a*) is fastened to (*a''*) only when we want to tighten the collapsed cradle body and stand together to carry, and when we want to fasten and carry the body individually; in this case we will fasten button (*a*) to its pair of (*a'*).

As it was already mentioned, it takes about 1 to 1.5 minutes to extend and set up the cradle as follows: Upon removing the cradle from its carton box, the handled band already talked about (FIG. 19) is removed from around the cradle. Initially the cradle stand (FIGS. 4 and 6) is set almost vertically on the ground (FIG. 10A position 4); while one hand is supporting it, each of the three prongs is moved individually of the side set on the ground from the star catch 9 and extended on the ground by the other hand. The tube 25 is then turned to the right, and at this time a sound will be heard which is actually the sound of jumping the tip *x* from the catch 43 to the slit *t*. It is obvious that turning the tube 25 to the right will change the place of the tri-prongs 26 from opposite point *e* to the opposite point *w*. Now the cradle stand is placed in the position 3 shown in FIG. 10A. The cradle stand is then placed in the position 2 in FIG. 10A, and the same action will be repeated precisely for the other side of the stand so that the cradle stand will be placed in position 1 shown in FIG. 10A. Now the two coupling mechanisms of the stand are extended and the stand is placed on the ground.

The important point is that the cradle will automatically adapt itself to any unlevelled or uneven ground and none of the four tubes 23 will be suspended in the air. The secret is that tip *x* of catch 43 is rather loose inside the slit *t* allowing the coupling mechanism of each side of the stand to move slightly to the left or right towards the axis 25 before the screws 1 on both sides of the cradle are tightened. However all the four tubes 23 will be set on any unlevelled ground and none of them will remain suspended in the air (FIG. 5).

Upon setting the cradle stand at the desired location and when all four tubes 23 are settled on the ground, the two screws of the two coupling mechanisms of the stand are turned to the right and properly tightened. Tightening the two screws will eliminate any looseness and noise from the cradle stand which will appear as though made of solid metal.

Another important point is that if the screws 1 are mistakenly or intentionally loosened and or even the double catches of stand or the catches 43 are released, the cradle stand will not bend or fold. This is because the tube 25 has to be turned to the left before the tube 23 or the coupling mechanisms of the stand can be folded, and this is not possible unless at least two of the tubes 23 belonging to one coupling mechanism can be lifted from the ground and then the tube 25 turned. In fact, the tube 25 will under no circumstances be turned to the right or left when the four tubes 23 are on the ground, and therefore the cradle stand will not be collapsed.

The secret lies in the coupling mechanism structure of the stand and the tube 25 whereby provisions are made that the stands cannot be collapsed by mistake during the use of the cradle.

To explain this let the two coupling mechanisms of the stand be called coupling mechanism number one and the other as coupling mechanism number two. Now assuming that the four tubes 23 of the cradle are set on the ground and the cradle stand is extended. Upon loosening the screws 1 and releasing the catches 43, let us see whether it is possible to turn the tube 25 to the left and open the cradle in the same condition. Trying to turn to the left the tube 25 relative to the coupling mechanism 1 will be equivalent to turning right the tube 25 relative to the coupling mechanism 2. Trying to turn left the tube 25 relative to the mechanism 2 will be equivalent to turning right the tube 25 relative to the coupling mechanism 1.

On the other hand, considering FIG. 6 we are aware of the principle that the tube 25 cannot be turned to the right when the coupling mechanism is extended. Therefore so long as the four tubes 23 are placed on the ground and at least two tubes 23 are not lifted from the ground, then the tube 25 will neither turn right nor left, and thus the cradle stand will not collapse. Referring to FIG. 18, the cradle body is shown in folded condition in this drawing.

To extend the body, the two tubes 50 of the upper part of body (FIG. 3) are slightly pressed in the direction of P arrows, which is in fact against the direction of the R arrows and the body is partly extended. The two parts 48 are pressed then with the two palms of hand in the direction of the N arrows so that the cradle will be fully extended. Now the extended body is connected with the cradle stand by joining the rings 6 to the hooks 18 (FIG. 3).

The part 17 is turned to the left to loosen and lift up the mosquito tubes 20 from the part 11 on both sides of the cradle. The tubes 20 are held at the desired height and then the part 17 is tightened by turning it to right to fix the tubes 20 and stop them from sinking into the tubes 11. The two ends of the tubes 20 are then joined to the tube 4. This is done by inserting the tubes 20 into the short tubes 5. The "cradle assembly" is now ready for use taking only between 60 to 90 seconds to extend and set up. It takes almost the same amount of time to collapse and fold the cradle enabling mothers to readily and speedily set it up and or fold it.

Figure 17A:
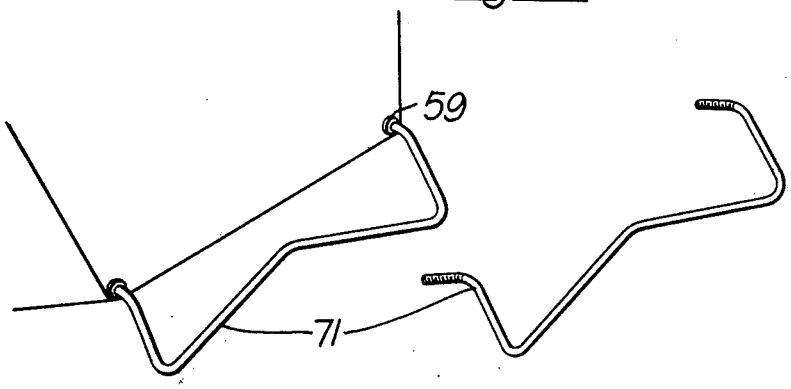
Figure 17B:
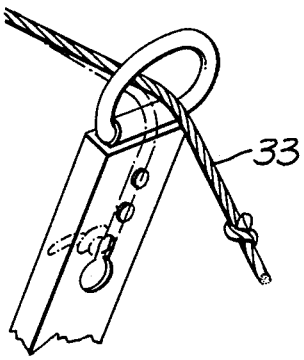

Mothers willing to carry the cradle outdoors without the stand and use it for instance in camping grounds may also carry two additional small stands 71, showin in FIG. 17A, and attach it to the cradle. The ends shown shaded are inserted into tubes 50 located at the lower part of the cradle body through parts 59. The provision of additional stands has resulted in creating a hole in each of the four parts 59 (FIG. 11) of the same diameter as the tubes of which the stands are made. When the cradle body is used individually for outdoors, the knots of narrow plastics rope 33 for the mosquito net (FIG. 17B) tied at the two ends will be placed at the two sides of the body inside some slits of the keyhole shape before the cradle body is opened and will join the two end of prong 36 together.

The length of the rope is such that it will be placed between the two ends of prong 36 in a fixed and straight way when the body is extended. Eliminating all or part of prongs 36 and adding the small stands 71 to the cradle body, it can be used as a collapsible bed in varying dimensions and sizes for both children and adults at home and during trips.

As was already mentioned, the $\alpha$ angle (FIG. 12) is of a special importance and it will cause the body not to collapse or fold under any circumstances when the cradle body is extended. This is because it will form into the position shown in FIG. 3 when the cradle body is fully extended by the pressure force of the two palms in the direction of the N arrows (FIG. 18). It is evident that the forces used in the direction of the N arrows to fully extend the cradle body and keep it open have actually pressed the cradle body's cover 8 and 31. Now these parts are under pressure when the body is full opened showing some reaction and pressing the body in the direction of the R arrows trying to collapse it.

The small α angle (FIG. 12) causes the four prongs 29 of the junction assembly of the body's two ends to be inclined inwards when the cradle body is extended, and the parts 48 to stand back outwards of the cradle body. In other words, the α angle has caused the body's junction assemblies centres on both ends of the cradle to stand outwards of the abcd surface (FIG. 3). Consequently the reaction of pressures received by the body cover (in the direction of the R arrows) will cause forces in the direction of the N arrows instead of causing forces in the direction of the K arrows to press the junction assemblies and collapse the cradle, and will press the junction assemblies centres to maintain the body in an extended position.

Some of the parts may be made by other methods including pressings instead of the casting system by injection moulding. Aluminium parts may be coated by Aluxall system if necessary.

It will be understood that the invention as claimed includes within its scope modified versions of the previously described assembly. For example, in FIG. 21 part N9 is the same as part 9 of FIG. 14 differing only in having therein circular recessions U and recessions T. FIG. 22 shows the parts forming the mosquito netting system or the new shade of the cradle. Parts 69 are the bolts, 63 the special rivets, part PN4 is the plastics or rubber cap, and parts PN1, PN2, PN3, and PN5 are the tubes. The new mosquitoe netting or shade system of the cradle can be used in the two following positions:

Position 1: Parts 63, 69, PN3 and PN2 will be permanently attached forming the component A as shown in FIG. 23. As shown in FIG. 23, the component A is attached by inserting part PN3 into one of the bent ends of the PN1 tube which is easily detachable. After assembly, the mosquito netting or the shade system may be mounted on the cradle as shown in FIG. 26 by inserting the two shaded ends of the tubes PN1 and PN2 into the parts N19.

Position 2: In FIG. 22, parts PN3, PN4, PN5 63, and 69 are permanently attached together as shown in FIG. 24 forming the component part B. As shown in FIG. 24, the component part B is attached to component part A by inserting the part PN3 into the bent end of PN2 tube, which is easily detachable; and after attachment the mosquito netting or the shade system may be mounted on the cradle as shown in FIG. 27 by inserting the shaded part of component part A into the part N19. Upon inserting the shaded part of component part A into part N19 as shown in FIG. 39, the bolt 69 will enter the slit Ω preventing the tube PN2 entering into part N19 more than necessary and also stopping the PN2 tube from rolling and turning inside part N19. Instead of using the special rivets 63, other techniques may be used to prevent the tube PN3 from being detached from the tube PN2 and the tube PN5.

The use of the bolt 69 in component part B is that when using the mosquito netting or the shade system as shown in FIG. 27, the string end of the shade cloth may be thrown behind the bolt 69 and tied to avoid slipping the cloth.

When collapsing the cradle to pack inside the box, parts PN1 and component parts A and B may be inserted into the openings U of star N9 using a slight pressure to lock and fasten it upon collapsing the cradle stand and locking the prongs N11 and 23 into the openings *d* of star N9. And as shown in FIG. 25, these parts (PN1, A and B) will be safely placed to avoid losing. Making a comparison between FIG. 39 and FIG. 20 the differences existing between the parts of these Figures will be known.

Upon mounting the part N24 on part N11, the parts PN6, and PN7 are mounted on the part N24. Then the tip Λ of part N24 will be hammered in so as to stop the part PN6 screwed like a nut on the part N24 from loosening, detaching or separating from part N24. Part N24's duty is just like the part 2-. By turning the part N24 in the direction of (0) arrow and lifting it after the part 37 (FIG. 3) is placed inside the opening H (FIG. 39), on turning and tightening the part PN6 we can stop the part N24 from looseness and make the cradle body stable.

Figure 32:
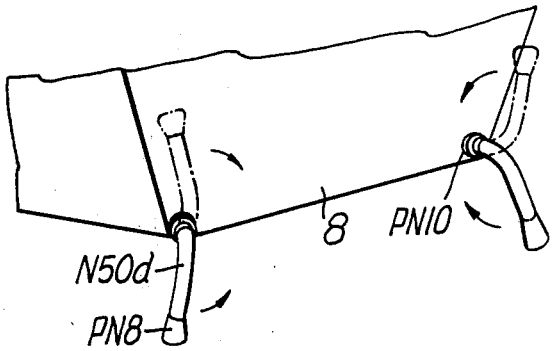
Figure 33:
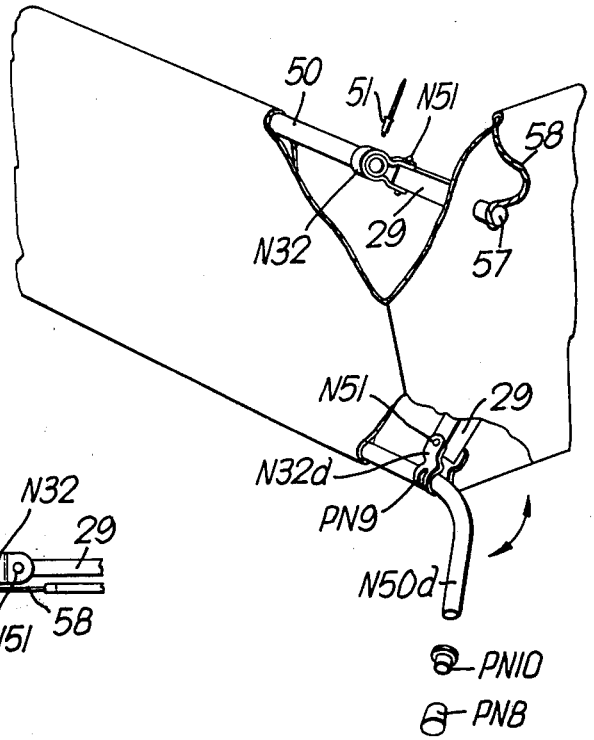
Figure 34:
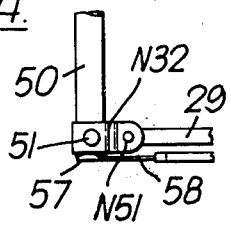

Part N62 may be omitted if the tube N11 is of steel, and the part 18 may be welded directly to the tube N11. A part of the lower cradle body is shown in FIG. 32. As it is shown in this Figure, the stands N50d are rotatable in the direction of arrows shown and may be placed on the floor as shown in FIGS. 32 and 37 and or turned into the position shown by dotted lines in FIGS. 32 and 38.

Figure 35:
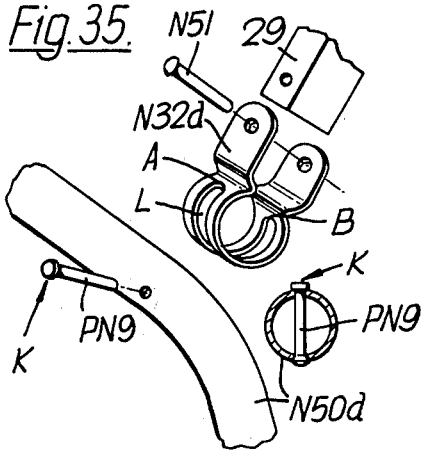
Figure 36:
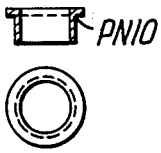

N50d stands should be placed in the position shown in FIG. 38 when the cradle body is mounted on its stand or when the cradle body is carried by the handles shown in dotted line in FIG. 38. As it is shown in FIG. 35, upon mounting the part N32d on the part N50d and attaching the part N32d to part 29 by the rivet N51, the part N50d can easily rotate inside the part N32d.

However to restrict the rotation degree of part N50d inside part N32d, the slit L is devised in part N32d. The rivet PN9 will enter the part N50d as shown one end of which will create the projection K, and the other end will be hammered and riveted in a way to create no projection on the part N50d.

The projection K will be placed inside the groove L and the projection K will rotate inside the groove L when the part N50d is rotated inside the part N32d. Turning the stands to the position shown in FIGS. 32 and 37, or in other words when the stands are placed on the floor, in this position the projection K will reach the point A of part N32d, and the stands cannot be extended and placed farther apart. Now turning the stands the other way round to the dotted line position shown in FIG. 32 or the position shown in FIG. 38, in this position the projection K will reach the point B of part N32d and cannot be rotated any farther. The part N32 is also like the part N32d differing only in slit L devised in part N32d. Upon inserting the tube 50 in part N32 which is already attached to part 29 by the rivet N51, the part 57 will be pressed into the end of tube 50 and then the three parts 57, 50 and N32 are attached together by the special rivet 51. Parts PN10, and PN8 caps are made of plastics or rubber.

As it is shown in FIG. 28, the only difference between part 2 and part N2 is that the part N2 has a space Z.

As it is shown in FIG. 31, the only difference between part 48 and N48 is that part N48 has 5 recessions *o*, *p*, *q*, R and X. Such recessions will reduce the weight of the part N48 and causing further improved production of part N48 by Die Casting.

The cradle may be carried by a composite mechanism of the special handle and belt (FIG. 19) when the cradle is fully collapsed, or alternatively just by any type of handle attached to the cradle case. Generally a simple belt can also be used to replace the composite mechanism of a special handle and belt.

The described and illustrated cot assembly will alleviate all mothers worries as to where to put their babies to bed wherever they are, as the cradle or bed in question can be carried and used anywhere due to its collapsibility, swift folding and extending, light weight construction, compactness, portability, water proof body and stand as well as other characteristics.

Mothers will therefore have the facility carried along with them whether at home, in parks, outdoors, hotels, pic-nics, campings, beaches or river sides during short and long trips, and they can carry it generally everywhere without the fear to wet places, mosquitoes, ground insects, and the hazards of exposing the baby to unconscious trampling by adults. The baby will have a special soft, safe, cozy and protected bed where he can sleep soundly giving the mothers a chance to handle their other essential works with ease of mind.

The compact collapsed cradle or bed can be easily carried by hand just like a small bag and can be placed in a car boot where it will occupy a small space. It can be easily and speedily extended and set up within one to one and a half minutes changing from a compact baggage into a spacious cradle or a solid bed. The stand automatically adapts to any uneven ground or unlevelled surface.

The assembly is ideal for nursery homes and child care centres as well as an interesting and valuable present for all mothers and newlyweds. The invention also includes a new portable and collapsible bed to carry infants inside the cars, airplanes, other land vehicles and boats. The invention can be also used for adults when made in larger dimensions. It can be manufactured and marketed in a large variety of colours, and finally it has been devised taking into account modern living requirements.

I claim:

1. A collapsible cot assembly, comprising an elongated frame member, two coupling hub mechanisms, each hub mechanism including a first part fixedly secured to one end of said frame member and a second part angularly movable with respect to the first part between first and second positions, leg members pivotally connected to each of said movable second parts for movement between stowed positions alongside said elongated frame member and deployed positions extending radially outwardly from said hub mechanisms, and means on said first fixed parts to hold said leg members in their deployed positions when said second parts are in said first positions and to permit movement toward said stowed positions only when said second parts are in said second positions.

2. The cot assembly of claim 1 further characterized by pin means for releasably retaining each of said second parts of said hub mechanism in said first positions.

3. The cot assembly of claim 1 further characterized by lock means for retaining said leg members in their stowed positions alongside side elongated frame member.

4. The cot assembly of claim 1 wherein three leg members are pivotally connected to each said hub mechanism, two of the three leg members providing support for the cot assembly when so deployed and the third leg member comprising an upright frame member and a cot skeleton and cot cover carried by said upright members.

5. An assembly as claimed in claim 4, in which the cot is formed by a skeleton and a cover mounted on the skeleton, and in which the skeleton comprises junction assemblies and elongate skeleton members, some of which are adjustably mounted on the junction assemblies for movement between an assembled position and a collapsed position.

6. An assembly as claimed in claim 5, in which said some skeleton members are rotatably mounted on the junction assemblies for movement between said assembled and collapsed positions.

7. An assembly as claimed in claim 5, in which the junction assemblies have appropriate recesses therein, and said some skeleton members are located in said appropriate recesses when in their assembled position.

8. An assembly as claimed in claim 5, in which each junction assembly includes a central portion pressure responsive to initiate movement of skeleton members from their assembled position to their collapsed position.

9. As assembly as claimed in claim 5, including attachment members mounted on said junction assemblies for location on connectors mounted on the stand.

10. An assembly as claimed in claim 9, in which each connector is a hook secured to an insert located in an upright frame member.

11. An assembly as claimed in claim 5, including an adjustably mounted insect net support structure.

12. An assembly as claimed in claim 11, in which the insect net support structure includes tubular members adjustably located on upright frame members by nut and bolt securing means.

13. A cot assembly comprising a collapsible stand and collapsible cot supported by said stand, said stand comprising two coupling mechanisms longitudinally spaced from one another, at least two radially outwardly extending leg members carried by each of said coupling mechanisms, and a cot support member angularly spaced from said leg members in said each coupling mechanism, each coupling mechanism including a housing member adjustably mounted in the said coupling mechanism and each coupling mechanism defining means to abut the support member and the leg members to retain them in their operational positions.

14. The cot assembly of claim 4 including a longitudinal frame member having ends connected to said coupling mechanisms, and lock means intermediate the ends of said frame member to retain said support members and said leg members in their collapsed positions.

* * * * *